US009734728B2

(12) United States Patent
Feyereisen et al.

(10) Patent No.: US 9,734,728 B2
(45) Date of Patent: Aug. 15, 2017

(54) SYSTEMS AND METHODS FOR DESTINATION SELECTION FOR VEHICLE INDICATIONS AND ALERTS

(71) Applicant: HONEYWELL INTERNATIONAL INC., Morristown, NJ (US)

(72) Inventors: Thea L. Feyereisen, Hudson, WI (US); Steve Johnson, North Bend, WA (US); Gang He, Morristown, NJ (US); Yasuo Ishihara, Kirkland, WA (US); Ivan Sandy Wyatt, Scottsdale, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 158 days.

(21) Appl. No.: 14/831,032

(22) Filed: Aug. 20, 2015

(65) Prior Publication Data

US 2017/0053539 A1 Feb. 23, 2017

(51) Int. Cl.
*G08G 5/02* (2006.01)
*G08G 5/00* (2006.01)

(52) U.S. Cl.
CPC ..... *G08G 5/025* (2013.01); *G08G 5/0021* (2013.01)

(58) Field of Classification Search
None
See application file for complete search history.

(56) References Cited

U.S. PATENT DOCUMENTS 5,523,949 A * 6/1996 Agate ..... G05D 1/0676 701/16
6,304,800 B1 * 10/2001 Ishihara ..... G08G 5/0086 340/947

(Continued)

FOREIGN PATENT DOCUMENTS

EP 2573586 B1 9/2014
EP 2866112 A2 4/2015

OTHER PUBLICATIONS

J,, Vinothkumar. et al. "Monitoring and Alerting System Integration in FMS Landing Phase using Image Fusion Techniques," International Journal of Emerging Technology and Advanced Engineering, Anna University, Chennai, India, vol. 2, Issue Nov. 11, 2012.

(Continued)

*Primary Examiner* — Jerrah Edwards
*Assistant Examiner* — Donald J Wallace
(74) *Attorney, Agent, or Firm* — Lorenz & Kopf, LLP

(57) ABSTRACT

A method for providing alerts or indications to an aircrew of an aircraft that is in-flight and approaching a destination airport includes receiving an aircrew runway selection from the aircrew of the aircraft, automatically generating a probable runway selection by the aircraft, and determining a position of the in-flight aircraft with reference to a threshold point. If the aircraft is prior to the threshold point, the method includes generating alerts and indications to the aircrew based solely on the received runway selection into the FMS from the aircrew of the aircraft and not on the automatically-generated probable runway selection from the aircraft. Alternatively, if the aircraft is past the threshold point, the method includes generating alerts and indications to the aircrew based solely on the automatically-generated probable runway selection from the aircraft and not on the received runway selection into the FMS from the aircrew of the aircraft.

10 Claims, 6 Drawing Sheets

(56) References Cited

U.S. PATENT DOCUMENTS

| | | | | |
|---|---|---|---|---|
| 7,363,145 | B2 | 4/2008 | Conner et al. | |
| 7,382,287 | B1 | 6/2008 | Chen et al. | |
| 7,797,086 | B2 | 9/2010 | Lorido et al. | |
| 8,589,071 | B2 | 11/2013 | Feyereisen et al. | |
| 2002/0099528 | A1 | 7/2002 | Hett | |
| 2004/0030465 | A1* | 2/2004 | Conner | G01S 19/15 701/16 |
| 2007/0120708 | A1* | 5/2007 | Ishihara | G08G 5/0082 340/963 |
| 2012/0215384 | A1* | 8/2012 | Fritz | G05D 1/0061 701/2 |
| 2013/0079958 | A1* | 3/2013 | Neri | G01S 19/15 701/16 |
| 2013/0271300 | A1* | 10/2013 | Pepitone | G01C 23/005 340/972 |
| 2014/0354456 | A1 | 12/2014 | Gannon et al. | |
| 2015/0112517 | A1* | 4/2015 | Conner | G05D 1/0077 701/16 |
| 2016/0362192 | A1* | 12/2016 | Roux | G08G 5/02 |

OTHER PUBLICATIONS

Extended EP Search Report for Application No. 16184632.4-1811 dated Apr. 1, 2017.
EP Examination for Application No. 16184632.4 dated Apr. 19, 2017.

* cited by examiner

SYSTEMS AND METHODS FOR DESTINATION SELECTION FOR VEHICLE INDICATIONS AND ALERTS

TECHNICAL FIELD

The exemplary embodiments described herein generally relate to vehicle operations, particularly, the automated indications and alerts that may be provided to the operator of a vehicle during operation of the vehicle. More specifically, the exemplary embodiments relate to systems and methods for destination selection for vehicle indications and alerts, with particular focus on aircraft applications.

BACKGROUND

Runway incursions and excursions stand as one of the greatest ongoing safety concerns to the airline industry. In recent years, runway related accidents have been responsible for more aviation fatalities than any other cause. With one incident reported, on average, every day globally, these potentially high-profile events can represent a significant cost to an airline's bottom line as well as negatively impact an airline's brand and reputation. To mitigate the risk of runway incursions and excursions, various flight crew indication and alerting technologies have been proposed. Examples of such technologies include the SmartRunway™ and SmartLanding™ systems available from Honeywell International Inc. of Morristown, N.J., USA. These technologies drastically increase safety by improving situational awareness for pilots and crew members during taxi and takeoff, approach, and landing.

Various benefits may be achieved with the use of flight crew indication and alerting technologies. For example, these technologies may provide timely positional advisories and graphical alerts to crew members during taxi, takeoff, final approach, landing, and rollout to reduce the likelihood of a runway incursion. In another example, they may provide indications and alerts when aircraft on approach are too high, too fast, or not properly configured for landing, and alerting to long landings and taxiway landings.

A fundamental basis of these technologies is a priori knowledge of the runway toward which the aircraft is approaching. Several technologies exist that allow these crew indication and alerting systems to make this determination. For example, the runway toward which the aircraft is approaching may be made known by the flight crew's entry into the flight management system (FMS) of the aircraft. In this example, the flight crew, using a primary flight display or a multi-function display of the aircraft, manually selects the destination airport, as well as the landing runway at the destination airport. In another, example, the runway toward which the aircraft is approach may be automatically selected by the aircraft based on various algorithms that utilize criteria such as aircraft position, altitude, descent/ascent rate, airspeed, and heading.

Various flight scenarios exist, however, where a change to the landing runway is made by the flight crew after already being established on the approach to another runway. One example of such a situation is the "side-step" approach. Side-step approaches may be performed at airports that have parallel runways, wherein the aircraft is initially cleared to approach a first of the two parallel runways, and subsequently "side-steps" to the other of the two parallel runways for landing. Under such scenarios, indication and alerting systems that are based on the flight crew's FMS runway entry would begin to generate unwanted alerts as soon as the aircraft begins the side-step manoeuver, unless the flight crew makes an effort to change the runway in the FMS (which would need to occur while the flight crew is required to perform various other tasks, such as landing checklists and briefings). Alternatively, indication and alerting systems that are based on the aircraft's automatic selection would begin to generate unwanted alerts if the algorithm is not accurate enough or timely enough to recognize the new (parallel) runway selection.

As is generally appreciated by those skilled in the art, undue or "nuisance" indications and alarms during landing are a distraction to the flight crew and contribute to stress attendant to a successful landing. Additionally, the nuisance indications and alarms may distract from critical alarms sounding in the cockpit. Therefore, it would be desirable to provide improved flight crew indication and alerting technologies that are capable of recognizing a side-step approach and providing only the indications and alerts that are relevant to the aircraft's approaching runway. Furthermore, other desirable features and characteristics of the exemplary embodiments will become apparent from the subsequent detailed description and the appended claims, taken in conjunction with the accompanying drawings and the foregoing technical field and background.

BRIEF SUMMARY

In general, this Application is directed to systems and methods for destination selection for vehicle indications and alerts. Accordingly, in one exemplary embodiment, a method for providing alerts or indications to an aircrew of an aircraft that is in-flight and approaching a destination airport includes the step of receiving a runway selection from the aircrew of the aircraft. The runway selection is one of the runways at the destination airport. Further, the runway selection is received into a flight management system (FMS) of the aircraft via flight crew entry of data into a primary flight display or a multi-function display of the aircraft. The method further includes the step of automatically generating a probable runway selection by the aircraft. The probable runway selection is automatically generated using an algorithm that utilizes one or more of an aircraft position, altitude, descent/ascent rate, airspeed, or track. Still further, the method includes determining a position of the in-flight aircraft with reference to a threshold point that includes both a threshold altitude and a threshold lateral distance from the destination airport. If the determined position of the in-flight aircraft with reference to the threshold point is both of above the threshold altitude and further from the destination airport than the threshold lateral distance, the method includes generating alerts and indications to the aircrew based solely on the received runway selection into the FMS from the aircrew of the aircraft. Alternatively, if the determined position of the in-flight aircraft is either below the threshold altitude or closer to the destination airport than the threshold lateral distance, the method includes generating alerts and indications to the aircrew based solely on the automatically-generated probable runway selection from the aircraft.

This brief summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely illustrative in nature and is not intended to limit the embodiments of the subject matter or the application and uses of such embodiments. Any implementation described herein as exemplary is not necessarily to be construed as preferred or advantageous over other implementations. Furthermore, there is no intention to be bound by any expressed or implied theory presented in the preceding technical field, background, brief summary, or the following detailed description.

Introduction

Figure 1:
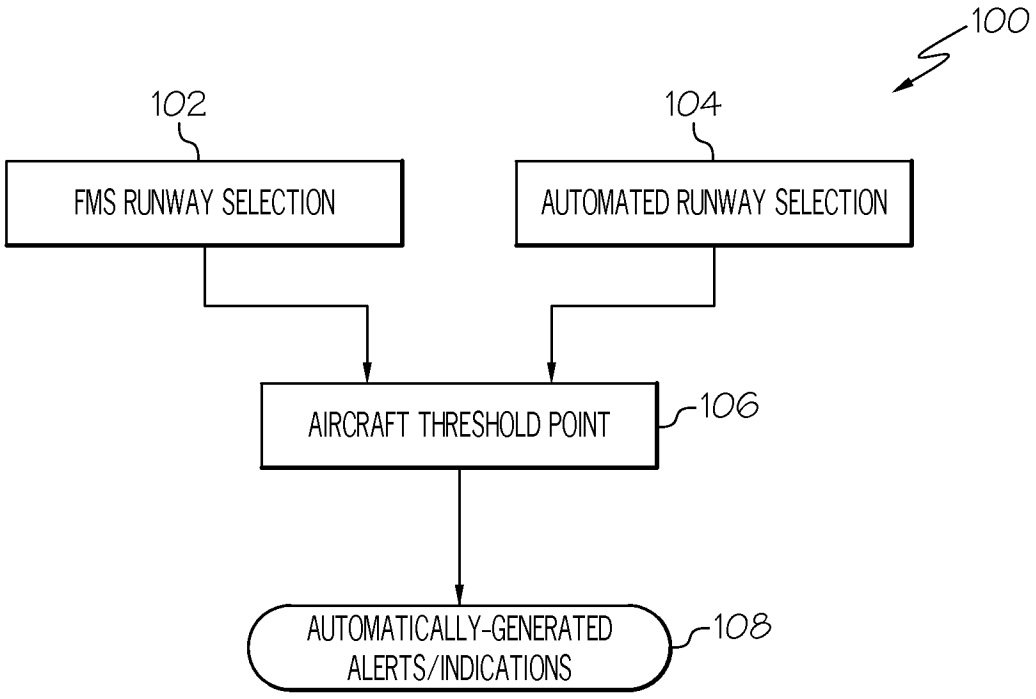
FIG. 1 is illustrative of the high-level aspects of a flight crew indication and alerting system in accordance with embodiments of the present disclosure.

The present disclosure broadly provides methods and systems for destination selection for vehicle indications and alerts. In the specific, non-limiting context of aircraft indications and alerts, FIG. 1 provides a high-level overview of system 100 for providing alerts or indications to an aircrew of an aircraft that is in-flight and approaching a destination airport. Particularly, the system 100 illustrates both a FMS runway selection means 102 and an automated runway selection means 104. The FMS runways selection means 102 is characterized as a means that receives a runway selection from the aircrew of the aircraft. The runway selection is one of the runways at the destination airport. For example, the runway selection is received into a flight management system (FMS) of the aircraft via flight crew entry of data into a primary flight display or a multi-function display of the aircraft. The automated runway selection means 104 is characterized as a means that automatically generates a probable runway selection by the aircraft. The probable runway selection is automatically generated using an algorithm that utilizes one or more of an aircraft position, altitude, descent/ascent rate, airspeed, or track. With further reference to system 100 in FIG. 1, the FMS runway selection 102 and the automated runway selection 104 are provided to a deterministic means that evaluates the aircraft current in-flight position with regard to a threshold point 106. The threshold point 106 may be predetermined, and it may be either statically-assigned or dynamically-determined. In either case, based on the position of the aircraft with respect to the threshold point, the system 100 automatically generates indications/alerts (108) that are based solely on either: 1) the determined position of the in-flight aircraft with reference to the threshold point that is both of above the threshold altitude and further from the destination airport than the threshold lateral distance; or 2) the determined position of the in-flight aircraft that is either below the threshold altitude or closer to the destination airport than the threshold lateral distance. For case 1), the method includes generating alerts and indications 108 to the aircrew based solely on the received runway selection into the FMS from the aircrew of the aircraft. Alternatively, for case 2), the method includes generating alerts and indications 108 to the aircrew based solely on the automatically-generated probable runway selection from the aircraft.

Figure 2:
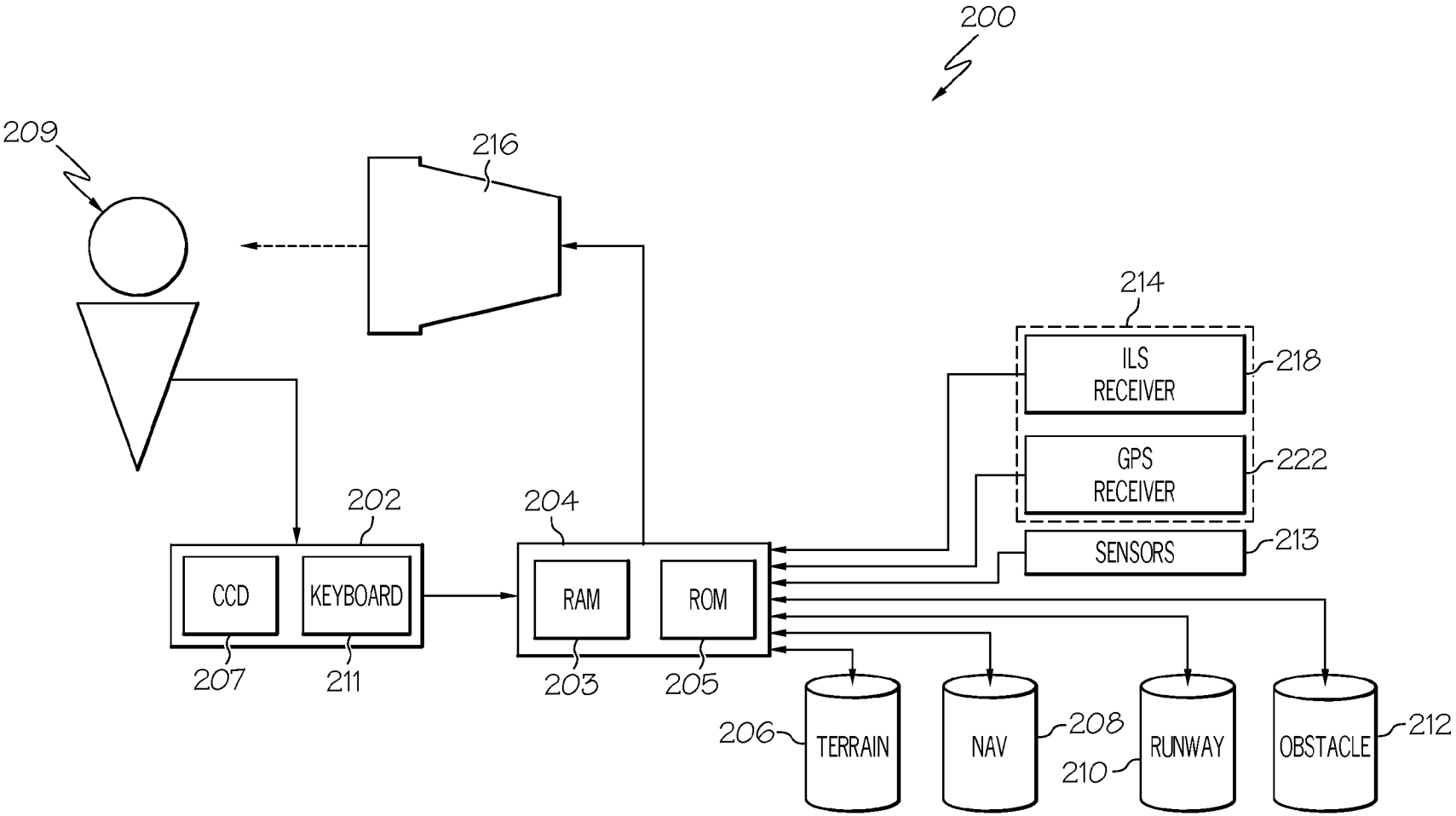
FIG. 2 is illustrative of an exemplary flight management system (FMS) that may be utilized in accordance with certain embodiments of the present disclosure.
Figure 3:
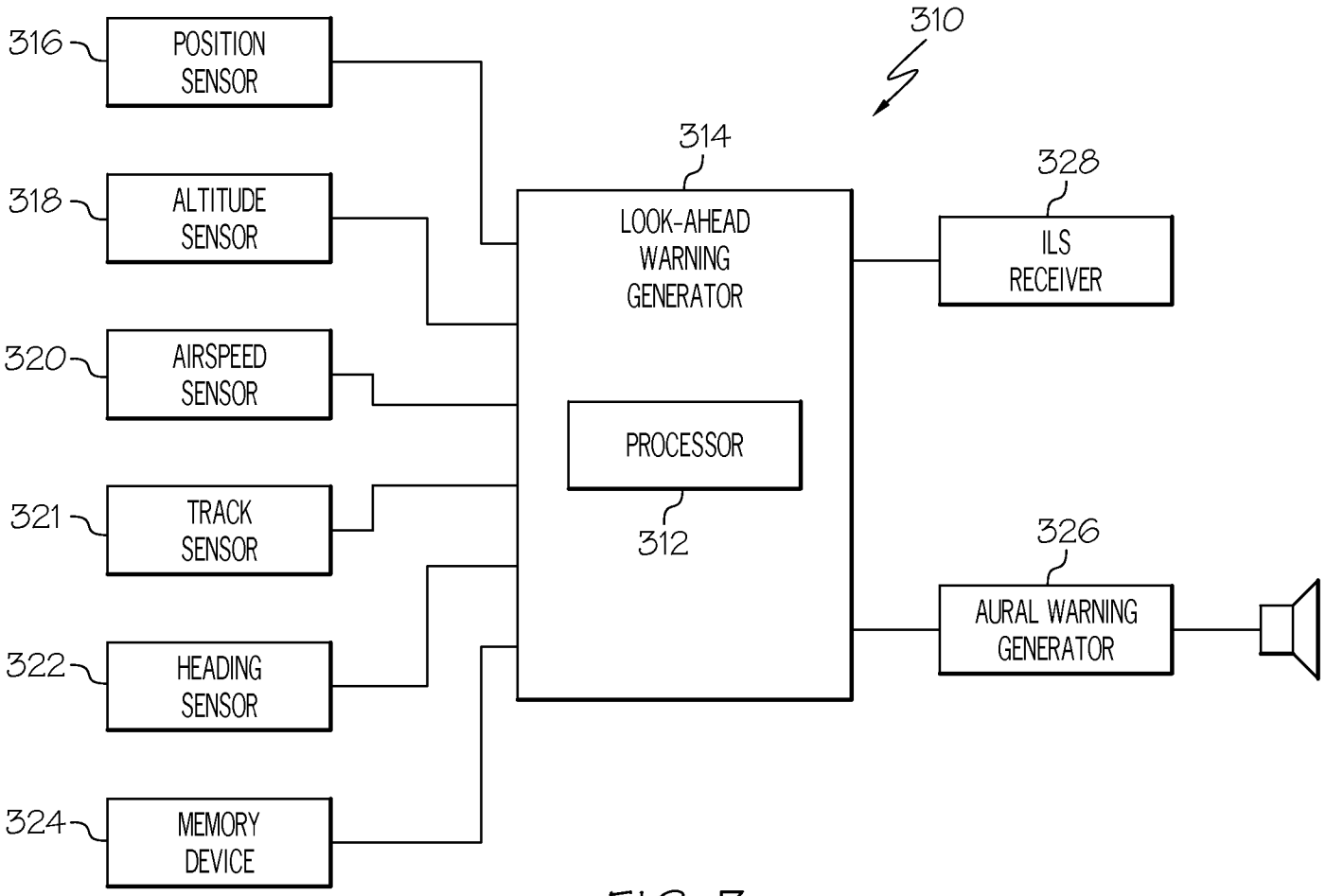
FIG. 3 is illustrative of an exemplary automatic runway selection system that may be utilized in accordance with certain embodiments of the present disclosure

As noted above, the flight crew may make a runway selection using the FMS, and the aircraft may automatically make a probable runway selection using various algorithms. For the former, FIG. 2 illustrates an exemplary flight management system that may serve as the means 102 in system 100. For the latter, FIG. 3 illustrates an exemplary automated runway determination systems that may serve as the means 104 in system 100. These various systems are described in greater detail in the paragraphs that follow.

Flight Management System (FMS) Runway Entry by Flight Crew

Referring now to FIG. 2, a flight management system (FMS) 200 includes a user interface 202, a processor 204, one or more terrain databases 206 (including runway and taxiway information), one or more navigation databases 208, one or more runway databases 210, one or more obstacle databases 212, sensors 213, external data sources 214, and one or more display devices 216. As noted above, this FMS system 200 may be supplied as or in place of the FMS runway selection means 102 of FIG. 1. The user interface 202 is in operable communication with the processor 204 and is configured to receive input from an operator 209 (e.g., a pilot) and, in response to the user input, supplies command signals to the processor 204. The user interface 202 may be any one, or combination, of various known user interface devices including, but not limited to, one or more buttons, switches, knobs, and touch panels (not shown). For example, the user interface 202 may include a cursor control device (CCD) 207 and a keyboard 211. As particularly relevant to this disclosure, the user interface 202 may be used by the operator 209 to select a destination airport for entry into FMS 200, and thereafter select a runway at the destination airport for landing.

The processor 204 may be implemented or realized with a general purpose processor, a content addressable memory, a digital signal processor, an application specific integrated circuit, a field programmable gate array, any suitable programmable logic device, discrete gate or transistor logic, discrete hardware components, or any combination designed to perform the functions described herein. A processor device may be realized as a microprocessor, a controller, a microcontroller, or a state machine. Moreover, a processor device may be implemented as a combination of computing devices, e.g., a combination of a digital signal processor and a microprocessor, a plurality of microprocessors, one or more microprocessors in conjunction with a digital signal processor core, or any other such configuration. In the depicted embodiment, the processor 204 includes non-transitory memory such as on-board RAM (random access memory) 203 and on-board ROM (read-only memory) 205. The program instructions that control the processor 204 may be stored in either or both the RAM 203 and the ROM 205. For example, the operating system software may be stored in the ROM 205, whereas various operating mode software routines and various operational parameters may be stored in the RAM 203. The software executing the exemplary embodiment is stored in either the ROM 205 or the RAM 203. It will be appreciated that this is merely exemplary of one scheme for storing operating system software and software routines, and that various other storage schemes may be implemented.

The memory 203, 205 may be realized as RAM memory, flash memory, EPROM memory, EEPROM memory, registers, a hard disk, a removable disk, a CD-ROM, or any other form of storage medium known in the art. In this regard, the memory 203, 205 can be coupled to the processor 204 such that the processor 204 can be read information from, and write information to, the memory 203, 205. In the alternative, the memory 203, 205 may be integral to the processor 204. As an example, the processor 204 and the memory 203, 205 may reside in an ASIC. In practice, a functional or logical module/component of the display system 200 might be realized using program code that is maintained in the memory 203, 205. For example, the memory 203, 205 can be used to store data utilized to support the operation of the display system 200 for receipt of operator 209 selections, as will become apparent from the following description.

No matter how the processor 204 is specifically implemented, it is in operable communication with the terrain databases 206, the navigation databases 208, the runway databases 210, the obstacle databases 212, and the display devices 216, and is coupled to receive various other avionics-related data from the external data sources 214, including ILS receiver 218 and GPS receiver 222, which may be used to determine the position of the aircraft with respect to the threshold point (means 106 of system 100). The processor 204 is configured, in response to the avionics-related data, to selectively retrieve terrain data from one or more of the terrain databases 206, navigation data from one or more of the navigation databases 208, runway data from one or more of the runway databases 201, and obstacle data from one or more of the obstacle databases 212, and to supply appropriate display commands to the display devices 216. The display devices 216, in response to the display commands, selectively render various types of textual, graphic, and/or iconic information.

The terrain databases 206, runway databases 210, and obstacle databases 212 include various types of data representative of the terrain and obstacles including taxiways and runways over which the aircraft is moving, and the navigation databases 208 include various types of navigation-related data. The external data source 214 may be implemented using various types of inertial sensors, systems, and or subsystems, now known or developed in the future, for supplying various types of inertial data, for example, representative of the state of the aircraft including aircraft speed, heading, altitude, and attitude. In at least one described embodiment, the sources 214 include an Infrared camera. The other sources 214 include, for example, an ILS 218 receiver and a GPS receiver 222. The ILS receiver 218 provides aircraft with horizontal (or localizer) and vertical (or glide slope) guidance just before and during landing and, at certain fixed points, indicates the distance to the reference point of landing on a particular runway. The ILS receiver 218 may also give ground position. The GPS 222 receiver is a multi-channel receiver, with each channel tuned to receive one or more of the GPS broadcast signals transmitted by the constellation of GPS satellites (not illustrated) orbiting the earth.

The display devices 216, as noted above, in response to display commands supplied from the processor 204, selectively render various textual, graphic, and/or iconic information, and thereby supplies visual feedback to the operator 209. It will be appreciated that the display devices 216 may be implemented using any one of numerous known display devices suitable for rendering textual, graphic, and/or iconic information in a format viewable by the operator 209. Non-limiting examples of such display devices include various flat panel displays such as various types of LCD (liquid crystal display), TFT (thin film transistor) displays, and projection display LCD light engines. The display devices 216 may additionally be implemented as a panel mounted display, or any one of numerous known technologies.

Automated Runway Selection System by Aircraft

The automated runway selection system by the aircraft is a system for predicting on which one of at least two candidate runways an aircraft is most likely to land. Broadly, the system includes a sensor that receives data representative of the position of the aircraft, a memory device containing data representative of the positions of at least two candidate runways, and a processor in electrical communication with the sensor and the memory device. The processor determines a reference angle deviation between the aircraft and each candidate runway, and the processor predicts the runway on which the aircraft is most likely to land based on the reference angle deviation. Automated runway selections systems of this type have been described in the prior art, for example in U.S. Pat. No. 6,304,800 and in U.S. Patent Application Publication No. 2007/0010921, the contents of which are herein incorporated by reference in their entirety.

FIG. 3 illustrates the functional components of an exemplary automated runway selection system 310 suitable for use with embodiments of the present disclosure. As initially noted above, this system 310 may be implemented as the automated runway selection means 104 shown in system 100. The system 310 may be configured as a part of an enhanced ground proximity warning system (EGPWS), for example. Specifically, the ground proximity warning system of this embodiment includes a look-ahead warning generator 314 that analyzes terrain and aircraft data and generates terrain profiles surrounding the aircraft. Based on these terrain profiles and the position, track, and ground speed of the aircraft, the look-ahead warning generator generates aural and/or visual warning alarms related to the proximity of the aircraft to the surrounding terrain. Some of the sensors that provide the look-ahead warning generator with data input concerning the aircraft are depicted in FIG. 3. Specifically, the look-ahead warning generator receives positional data from a position sensor 316. The position sensor may be a portion of a global positioning system (GPS), inertial navigation system (INS), or flight management system (FMS). The look-ahead warning generator also receives altitude and airspeed data from an altitude sensor 318 and airspeed sensor 320, respectively, and aircraft track and heading information from track 321 and heading 322 sensors, respectively.

The system 310 shown in FIG. 3 is further capable of predicting which runway of at least two candidate runways on which an aircraft is most likely to land. In one embodiment of the present disclosure, the apparatus includes a processor 312 located in the look-ahead warning generator. The processor may either be part of the processor of the look-ahead warning generator or it may be a separate processor located either internal or external to the look-ahead warning generator. The processor 312 accesses data relating to the aircraft and each of the candidate runways. In operation, the processor analyzes the data relating to each candidate runway and the aircraft and determines a reference angle deviation between the aircraft and each candidate runway. Based on the reference angle deviation associated with each candidate runway, the processor predicts the candidate runway on which the aircraft is most likely to land. The predicted runway may then be used by the deterministic means 106 of system 100, as described above, for generating indications/alerts 108.

More specifically, the system 310 evaluates each candidate runway based on a reference angle deviation between the aircraft and each candidate runway. Depending upon the embodiment, the reference angle deviation between the aircraft and each candidate runway may represent several alternative angular relationships between the aircraft and each candidate runway. For instance, in one embodiment of the present disclosure, the reference angle deviation determined by the processor for each candidate runway may represent a bearing angle deviation. Bearing angle deviation in this embodiment is defined as an angle of deviation between the position (i.e., latitude and longitude) of the aircraft and the position of each candidate runway. In this embodiment of the present disclosure, the processor accesses data relating to the position of each candidate runway and the current position of the aircraft. Based on the relative positions of each candidate runway and the aircraft, the processor determines a bearing angle deviation between the aircraft and each candidate runway. The processor next analyses the bearing angle deviation associated with each candidate runway and predicts which runway the aircraft is most likely to land.

Similarly, in another embodiment of the present disclosure, the reference angle deviation between the aircraft and each candidate runway may represent a track angle deviation. Track angle deviation is defined in this embodiment as an angle of deviation between a direction in which the aircraft is flying and a direction in which each candidate runway extends lengthwise. In this embodiment of the present disclosure, the processor accesses data relating to the direction in which the aircraft is flying and information for each candidate runway relating to the direction in which each candidate runway extends lengthwise. Based on this data, the processor determines a track angle deviation between the aircraft and each candidate runway. The processor next analyzes the track angle deviation associated with each candidate runway and predicts which runway the aircraft is most likely to land.

Further, in another embodiment of the present disclosure, the reference angle deviation between the aircraft and each candidate runway may represent a glideslope angle deviation. Glideslope angle deviation is defined in this embodiment as a vertical angle of deviation between the position of the aircraft and each candidate runway. Specifically, the glideslope angle relates to the approach angle of the aircraft in relation to the runway. Typically, when landing, and aircraft will approach the runway within a predetermined range of angles. Approach angles above this range are typically considered unsafe for landing. As such, an aircraft that has a vertical angle with respect to the runway that is within the predetermined range of angles is more likely to be landing on the runway, and likewise, an aircraft that has a vertical angle with respect to the candidate runway that is greater than the predetermined range of angles is most likely not landing on the candidate runway.

In this embodiment of the present disclosure, the processor accesses data relating to the position of the aircraft and position information for each candidate runway. Based on this data, the processor determines a glideslope angle deviation between the position of the aircraft and each candidate runway. The processor next analyses the glideslope angle deviation associated with each candidate runway and predicts which runway the aircraft is most likely to land.

Although many different criteria may be used in analyzing the reference angle associated with each candidate runway, in some embodiments, it is advantageous to use an empirical method for predicting which runway the aircraft is most likely landing. In this embodiment of the present disclosure, the processor compares the reference angle associated with each candidate runway to a likelihood model. The likelihood model is an empirical model that represents the likelihood that an aircraft is landing on a candidate runway based on the reference angle between the runway and the aircraft. In one embodiment of the present disclosure, the candidate runway having an associated reference angle that, when applied to the likelihood model, produces the greatest likelihood value is predicted as being the runway on which the aircraft is most likely landing.

As discussed earlier, the present disclosure in some embodiments, may evaluate a bearing, track, or glideslope angle deviation. Depending on the embodiment, the likelihood model may represent the likelihood that an aircraft will land on a candidate runway based on differing criteria. Specifically, in embodiments, which evaluate the bearing angle deviation between the aircraft and each candidate runway, the likelihood model will represent the likelihood that an aircraft will land on a candidate runway based on the bearing angle deviation between the aircraft and the runway. Likewise, in the embodiment in which the present disclosure evaluates the track angle deviation between the aircraft and each candidate runway, the likelihood model will represent the likelihood that an aircraft will land on a runway based on the track angle of deviation between the aircraft and the runway. Similarly, in the embodiment in which the present disclosure evaluates the glideslope angle deviation between the aircraft and each candidate runway, the likelihood model will represent the likelihood that an aircraft will land on a candidate runway based on the glideslope angle of deviation between the aircraft and the runway.

Threshold Point and Alerts/Indications

The threshold point utilized by deterministic means 106 may be pre-determined in the sense that the criteria for determining the threshold point may be known to the system 100 prior to the selection of the destination airport and/or the selection of the landing runway. The threshold point includes a vertical distance component above the elevation of the runway threshold, and a lateral (overland) distance component in front of the runway threshold. In some embodiments, the threshold may be statically assigned. That is, fixed values are used for the vertical distance component and the lateral distance component. In other embodiments, the threshold may be dynamically determined based on various factors such as aircraft type, aircraft weight, weather conditions, airspeed, runway length, and the presence of terrain or obstacles, among other considerations. Exemplary values for the vertical distance component may be 100 ft. above the runway threshold to 1000 ft. above the runway threshold, with about 300 being preferred. Exemplary values for the lateral distance component may be ¼-mile before the threshold to 3 miles before the threshold, with about 1 mile being preferred. Where dynamically-determined, the values may increase with increasing aircraft weight and speed and with shorter runways, for example. The values may decrease for clear weather and the lack of surrounding terrain and obstacles, for example.

The alerts and indications that may be provided in accordance with the present disclosure are those particularly related to the approach of the aircraft to the runway. Alerts and indications may be one or more of audio, visual, tactile, etc. Exemplary alerts and indications may include those with regard to an aircraft that is too high or too low on the approach, too fast or too slow, not in landing configuration, not stabilized on the approach, not in-line with the runway, etc.

Illustrative Example for Side-Step Approach

Figure 4A:
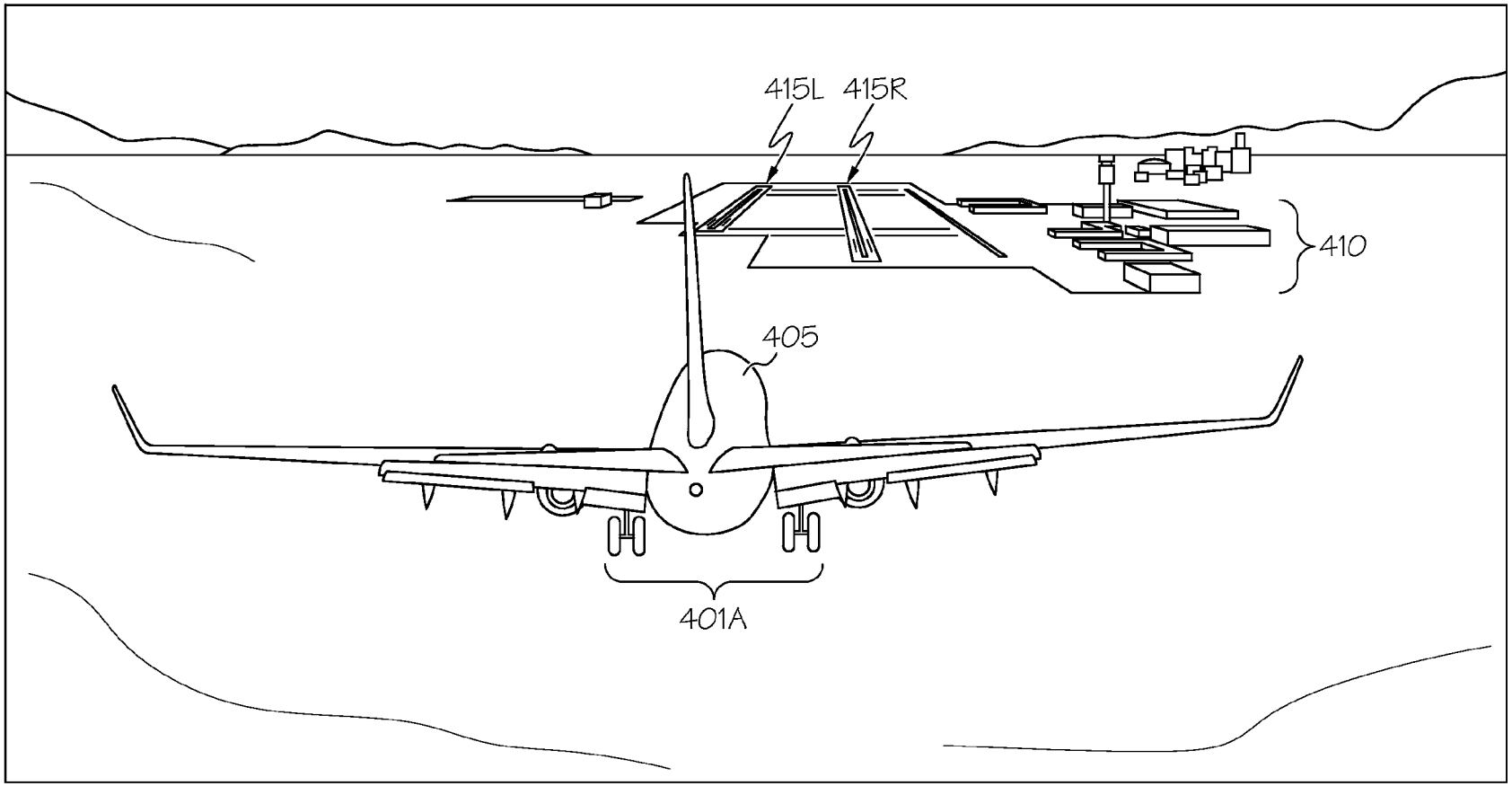
FIG. 4A is illustrative of the position of an aircraft upon initiating an approach to a runway at an airport that includes at least two parallel runways.
Figure 4B:
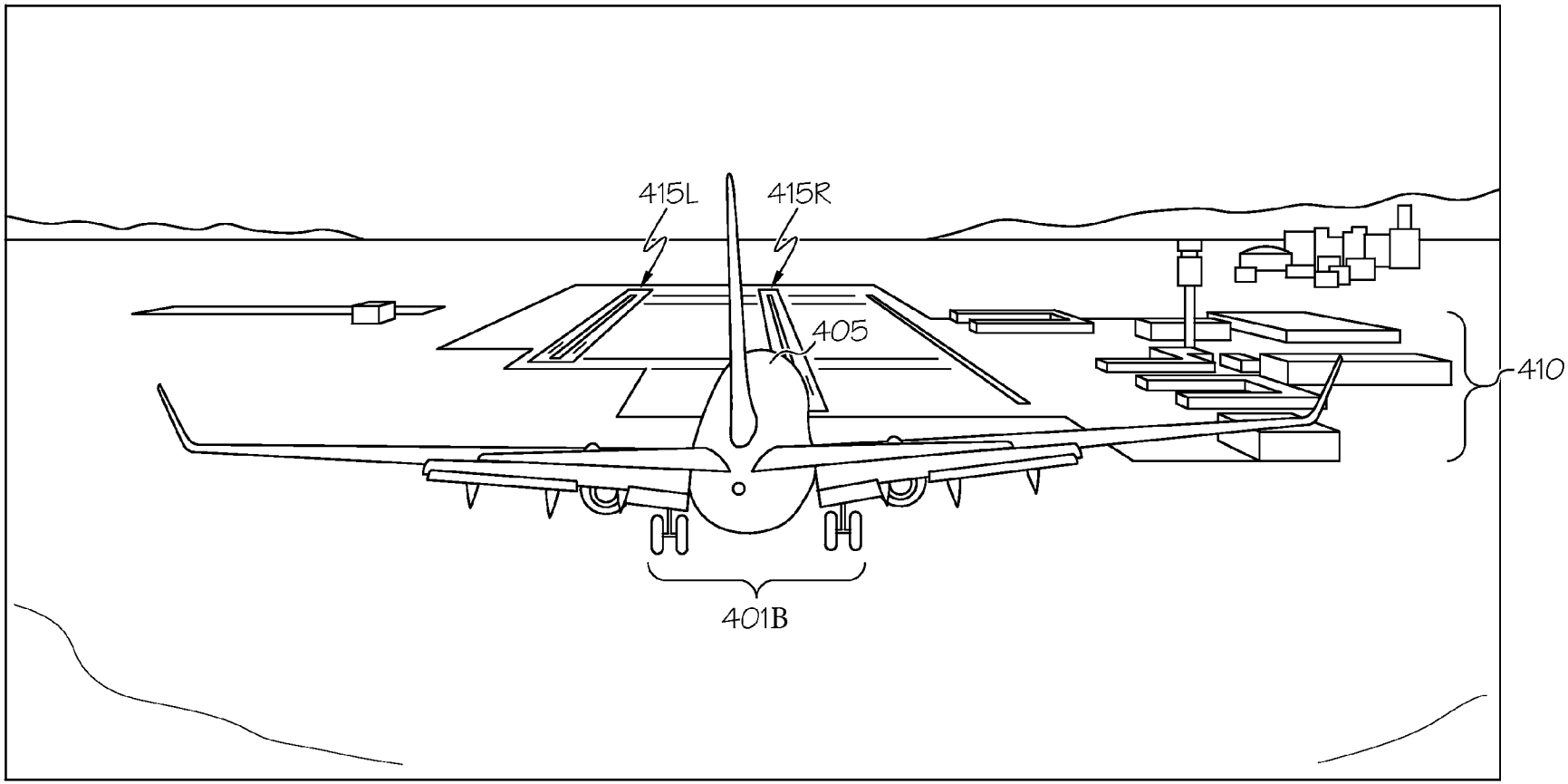
FIG. 4B is illustrative of the position of an aircraft, as per FIG. 4A, that is further along the approach, but has performed a side-step manoeuver to the parallel runway.

FIGS. 4A and 4B provide an illustrative example of an aircraft performing a sidestep approach procedure using the system 100 as described above. More specifically, FIG. 4A is illustrative of the position of an aircraft upon initiating an approach to a runway at an airport that includes at least two parallel runways, whereas FIG. 4B is illustrative of the position of an aircraft, as per FIG. 4A, that is further along the approach, but has performed a side-step manoeuver to the parallel runway.

This example begins with the aircrew of the aircraft, while in flight, determining a destination airport 410. The destination airport selection is made into the FMS, as described above with regard to FIG. 2. While proceeding toward the destination airport, as a result of air traffic control assignment, or as a result of crew determination, the aircrew further enters into the FMS a runway selection at the destination airport, as set for above with regard to means 102 of system 100. On an automatic basis and without the need for further input by the aircrew, the automated runway selection system 310, functioning as means 104 of system 100, evaluates the various parameters of flight and makes a probable runway selection of one of the two or more available runways at the destination airport 410. The selections from means 102 and 104 are then fed to the deterministic means 106, with reference to the threshold point as described above.

As a base case, assume a situation wherein the aircraft is still some distance from landing and the aircrew has selected airport 410 in the FMS for landing, and further assume that runway 415L has been selected in FMS, and the aircraft is not lined up with 415L or 415R but closer to 415R such that the automatic runway selection logic happens to pick 415R as the most likely runway (different from aircrew intent at this point). In this manner, the benefit of using the FMS-selected runway at this further-out point in space over the automatic runway selection is clear. Alerts will be directed to the selected runway 415L.

Next, turning now to the Figures, in FIG. 4A, let it be assumed that the aircrew has selected airport 410 in the FMS, and has further selected runway 415L for landing. Let it also be assumed that the automated runway selection system is currently predicting 415L for landing. FIG. 4A illustrates the aircraft 405 at a point 401A along the approach to runway 415L for landing. Assume that point 401A is prior to the threshold point, which in this example may be the preferred 300 ft. above runway threshold and 1 mile in front of the threshold. At point 401A, then because the aircraft 401A is both above 300 ft. above the runway threshold and greater than 1 mile in longitudinal distance in front of the threshold, system 100 will generate alerts and indications based solely on the aircrew-entered FMS runway selection (in this case, 415L) and not based on the automated selection (also in this case 415L).

Now, moving to FIG. 4B, assume the aircraft 405 receives an instruction from air traffic control to perform a side-step to runway 415R. As shown in FIG. 4B, the aircraft moves to the right, and is now a position 401B that is closer to the airport 410 and past the threshold (i.e., either or both of less than 300 ft. above the runway threshold and less than 1 mile in front of the runway threshold). That is, FIG. 4B now illustrates that the aircraft has performed the side-step, and is now in line to land on runway 415R. However, it may be the case that, due to the high work-load imposed on the aircrew at this point along the approach to landing, there may not be enough time for the aircrew to change the FMS entry to the new runway. But, the automated runway selection system would likely have ascertained a new probably runway as 415R. Thus, in prior art systems, there would likely be unwanted alerts/indications generated as the aircraft 405 deviated from the approach path of 415L to the approach path of 415R as per the side-step manoeuver. In the presently described embodiments, with the aircraft 405 being past the threshold, the alerts/indications are now solely based on the automated runway selection, which as noted above, has ascertained the new runway based on the aircrafts change in position and heading, and not on the FMS runway selections, which may not have been changed to reflect the side-step. In this manner, unwanted alters/indications are avoided, as the system 100 is now providing alerts/indications on the basis of the newly-determined runway 415R.

Figure 5:
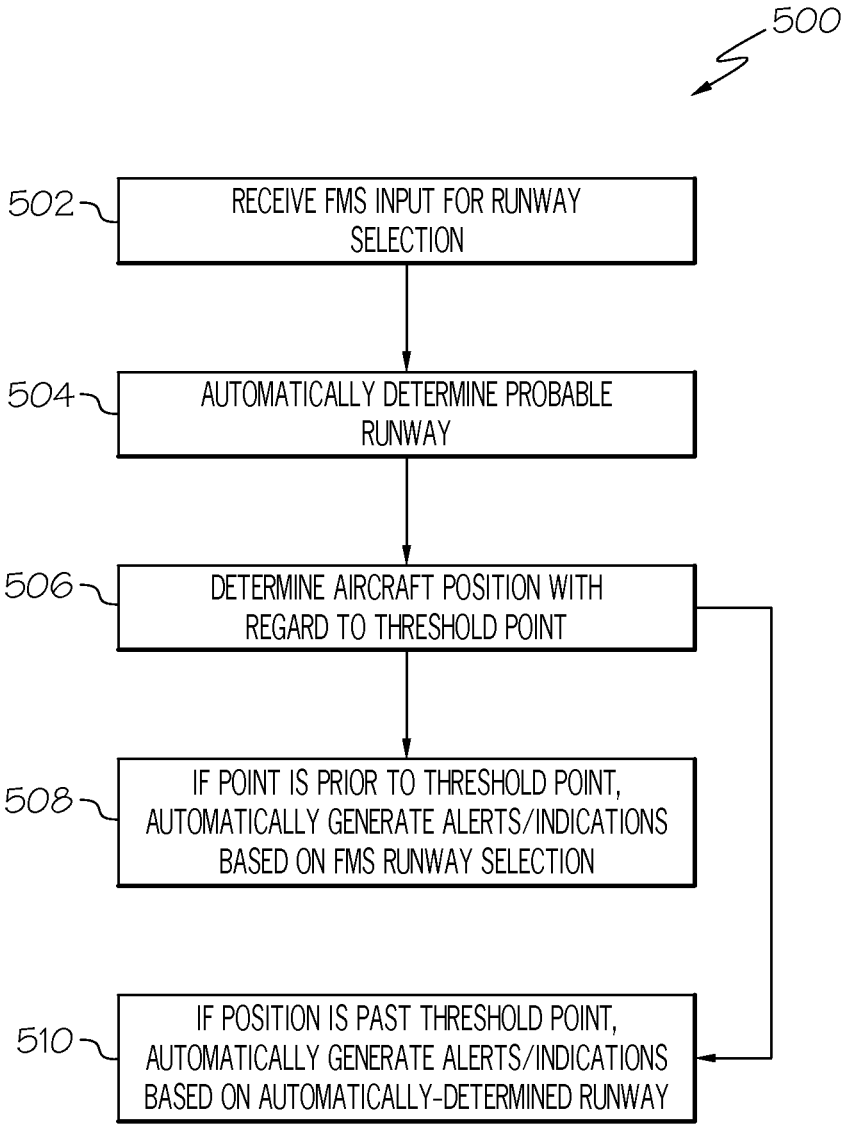
FIG. 5 is illustrative of a method for destination selection for vehicle indications and alerts in accordance with certain embodiments of the present disclosure.

Accordingly, FIG. 5 provides a method 500 for destination selection for vehicle indications and alerts in accordance with certain embodiments of the present disclosure. At step 502, the aircraft FMS receives a selection by the aircrew of a runway selection at a destination airport. At step 504, the aircraft automatically determines a probable runway based on the aircraft position, track, glide path angle, etc. At step 506, the aircraft's position is determined with respect to a threshold point, which includes both a vertical component and a lateral component. Based on the determination of the aircraft position with respect to the threshold point, if the position is prior to reaching the threshold point, step 508 is performed wherein the aircraft generates alerts and indications based solely on the aircrew's FMS runway selection and not based on the aircraft's own automated determining. However, if the position is past reaching the threshold point, step 510 is performed wherein the aircraft generates alters and indication bases sole on the aircraft's automated determination of the landing runway and not based on the aircrew's FMS selection.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims.

What is claimed is:

1. A method for providing alerts or indications to an aircrew of an aircraft that is in-flight and approaching a destination airport, the method comprising the steps of:

receiving an aircrew runway selection from the aircrew of the aircraft, wherein the aircrew runway selection is one of two or more runways at the destination airport, and wherein the runway selection is received into a flight management system (FMS) of the aircraft via flight crew entry of data into a primary flight display or a multi-function display of the aircraft;

automatically generating a probable runway selection by the aircraft, wherein the probable runway selection is one of the two or more runways at the destination airport, and wherein the probable runway selection is automatically generated using an algorithm that utilizes one or more of an aircraft position, altitude, descent/ascent rate, glide path angle, ground speed, or track;

determining a position of the in-flight aircraft with reference to a threshold point that comprises both a threshold altitude and a threshold lateral distance from the destination airport, wherein:

if the determined position of the in-flight aircraft with reference to the threshold point is both of above the threshold altitude and further from the destination airport than the threshold lateral distance, the method comprises generating alerts and indications to the aircrew based solely on the received runway selection into the FMS from the aircrew of the aircraft and not on the automatically-generated probable runway selection from the aircraft;

alternatively, if the determined position of the in-flight aircraft is either below the threshold altitude or closer to the destination airport than the threshold lateral distance, the method comprises generating alerts and indications to the aircrew based solely on the automatically-generated probable runway selection from the aircraft and not on the received runway selection into the FMS from the aircrew of the aircraft.

2. The method of claim 1, further comprising pre-determining the threshold point based on a fixed value above a landing runway threshold and a fixed lateral distance in front of the runway threshold.

3. The method of claim 2, wherein the fixed value comprises from 100 ft. above the landing runway threshold to 1000 ft. above the landing runway threshold, and from ¼-mile before the landing runway threshold to 3 miles before the landing runway threshold.

4. The method of claim 2, wherein the fixed value comprises about 300 ft. above the landing runway threshold and about 1 mile before the landing runway threshold.

5. The method of claim 1, further comprising pre-determining the threshold point based on dynamic factors comprising one or more of aircraft type, aircraft weight, weather conditions, airspeed, runway length, and presence of terrain or obstacles.

6. The method of claim 1, wherein generating alerts and indications comprises generating one or more of the following types of alerts and indications: aircraft that is too high or too low on the approach, too fast or too slow, not in landing configuration, not stabilized on the approach, not aligned with the runway.

7. A system for providing alerts or indications to an aircrew of an aircraft that is in-flight and approaching a destination airport, the system comprising:

an aircrew runway selection means that receives a runway selection from the aircrew of the aircraft, wherein the aircrew runway selection is one of two or more runways at the destination airport;

an automated runway selection means that generates a probable runway selection by the aircraft, wherein the probable runway selection is one of the two or more runways at the destination airport, and wherein the probable runway selection is automatically generated using an algorithm that utilizes one or more of an aircraft position, altitude, descent/ascent rate, glide path angle, ground speed, or track;

a deterministic means that determines a current position of the aircraft with reference to a threshold point that comprises both a threshold altitude and a threshold lateral distance from the destination airport; and an indication/alert generating means which, if the determined position of the in-flight aircraft with reference to the threshold point is both of above the threshold altitude and further from the destination airport than the threshold lateral distance, generates alerts and indications to the aircrew based solely on the received runway selection from the aircrew of the aircraft and not on the automatically-generated probable runway selection from the aircraft, but which, if the determined position of the in-flight aircraft is either below the threshold altitude or closer to the destination airport than the threshold lateral distance, generates alerts and indications to the aircrew based solely on the automatically-generated probable runway selection from the aircraft and not on the received runway selection from the aircrew of the aircraft, wherein the indication/alert generating means generates indications/alerts that comprise one or more of the following types of alerts and indications: aircraft that is too high or too low on the approach, too fast or too slow, not in landing configuration, not stabilized on the approach, not in-line with the runway.

8. The system of claim 7, wherein the aircrew runway selection means comprises a flight management system (FMS) of the aircraft.

9. The system of claim 7, wherein the automated runway selection means comprises a sensor that receives data representative of the position of the aircraft, a memory device containing data representative of the positions of at least two candidate runways, and a processor in electrical communication with the sensor and the memory device, which determines a reference angle deviation between the aircraft and each candidate runway, and predicts a runway on which the aircraft is most likely to land based on the reference angle deviation.

10. The system of claim 7, wherein the threshold point is fixed value that comprises from 100 ft. above the landing runway threshold to 1000 ft. above the landing runway threshold, and from ¼-mile before the landing runway threshold to 3 miles before the landing runway threshold.

* * * * *